United States Patent [19]

Rastutis

[11] Patent Number: 4,930,177

[45] Date of Patent: Jun. 5, 1990

[54] SCRAPER FOR THE FRICTION SEAL OF PAINT CANS

[76] Inventor: John F. Rastutis, 4625 Vista St., Long Beach, Calif. 90803

[21] Appl. No.: 397,235

[22] Filed: Aug. 23, 1989

[51] Int. Cl.[5] ..... B44D-3/16

[52] U.S. Cl. ..... 15/105; 15/236.05

[58] Field of Search ..... 15/236.05, 105

[56] References Cited

U.S. PATENT DOCUMENTS

| | | | |
|---|---|---|---|
| D. 243,312 | 7/1977 | Chaney . | |
| 1,211,098 | 1/1917 | Darrin | 15/236.05 |
| 2,652,582 | 9/1953 | McCroba | 15/236.05 |
| 2,777,676 | 1/1957 | Carter . | |
| 2,860,858 | 11/1958 | Kurs . | |
| 3,310,826 | 3/1967 | Ellis | 15/236.05 X |
| 4,628,563 | 12/1986 | Kramer | 15/236.05 X |

*Primary Examiner*—Chris K. Moore

*Attorney, Agent, or Firm*—L. Lee Humphries

[57] ABSTRACT

A scraping tool for removing paint residue from the friction seal of paint cans. The tool includes a handle (10) of sufficient size to accommodate a human hand from which one of two scraping blades continue. Extending from the fore end of the tool is a rim scraping blade (20) while conversely extending from the aft end is a lid scraping blade (30). The blades have contour edges shaped to approximate the cross sectional configuration of the rim and lid components of a paint can friction seal. The seal is cleaned completely, as the tool is designed to address both the rim and lid. Due to slightly smaller or larger blade dimensions, in respect to the seal configuration, the tool is allowed to move without encumbrance over the seal surface as it is cleaned. The blades are shaped to correspond specifically to the surfaces of the friction seal, permitting the tool to be used on assorted sizes of the cans as well as those of various manufacture.

5 Claims, 2 Drawing Sheets

SCRAPER FOR THE FRICTION SEAL OF PAINT CANS

FIELD OF INVENTION

This invention relates to scraping tools, specifically to tools used for removing paint residue from the rim and lid of paint cans.

BACKGROUND

Paint, when purchased from a paint store or other supplier, is in most cases, contained in a metal can having a friction seal top. Paint is dispensed from the can generally in one of two ways: (1) by dipping a brush or similar object directly into the can, or (2) by pouring the paint out of the can into a receptacle for dipping, rolling or spraying. When paint is dispensed from the can in either of these two ways, the action of dipping or pouring is often repeated many times. As excess paint is left to dry on the rim and lid, an accumulation of paint residue can occur which a paintbrush is unable to remove. The stratified paint on the can rim and lid diminishes the performance of the friction seal appreciably. As the lid is joined to the can, an uneven mating surface, formed by paint residue, can create gaps around the seal. These gaps allow air to circulate in an otherwise airtight chamber. This can cause the remaining paint in the can to dry and harden due to evaporation. Furthermore, in storage, the excess paint around the seal can become concrete, causing the lid to be fused to the can. In this condition, a great deal of effort is required to remove the lid from the can. As various devices are used to extricate the lid by wedging, the lid and rim can become distorted, resulting in a permanent loss of friction seal integrity. Even if no damage to the seal has occured, pieces of rigid paint may be securely attached to both the rim and lid. This residue can severely impair the function of the seal.

OBJECTS AND ADVANTAGES

Accordingly, there are several objects and advantages of the present invention.

Principally, an object of the invention is to provide a hand-held scraping tool which will remove accumulated paint residue from the surfaces of a paint can friction seal. The function of the seal to provide for an airtight and leak proof container is greatly improved by the removal of rigid paint from the seal surface. Thus, saving the consumer the cost of replacing paint made unusable by evaporation. In addition, the removal of excess paint residue helps to prevent the lid from becoming fused to the can, permitting easy extrication of the lid, even after storage.

Another object is to provide a scraping tool which comprises blades for scraping the can rim as well as the lid. The friction seal is cleaned completely as the tool is designed to scrape, or clean, both the rim and lid components of the seal.

A further object is to provide a scraping tool with blades shaped to correspond specifically to the surfaces of the friction seal. This allows the tool to be used on assorted sizes of paint cans, including those with gallon, quart and pint size capacities. The blade shapes also permit the tool to be used on cans of various manufacture which may vary slightly in friction seal cross section configuration.

Still another object is to provide a scraping tool which is economical to produce. The low cost could be passed on to the consumer or permit the tool to be used as a complimentary or promotional item.

Further objects and advantages of my invention will become apparent from a consideration of the drawings and ensuing description of it.

DESCRIPTION

Figure 1:
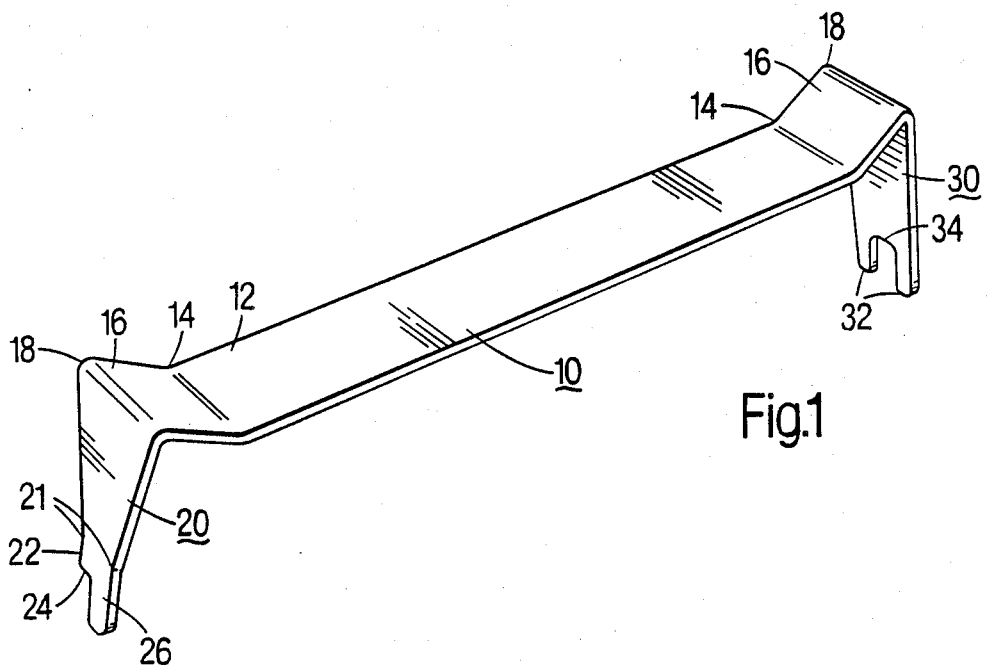
FIG. 1 is an isometric view of a scraping tool according to the present invention.
Figure 2:
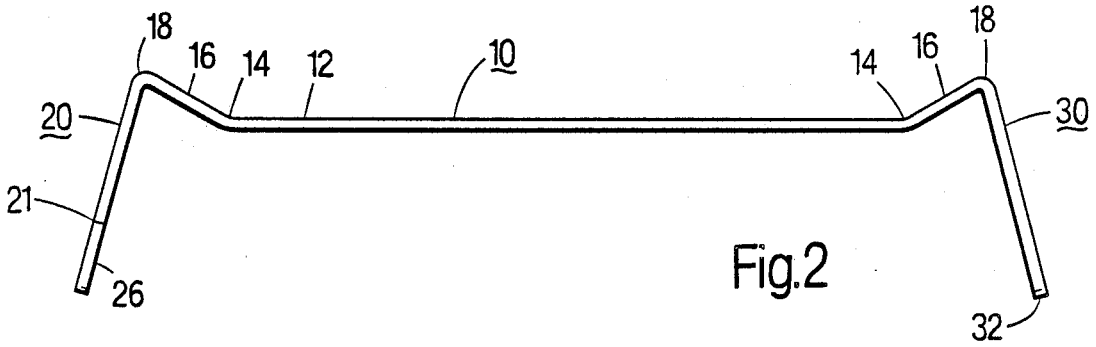
FIG. 2 is a side elevational view of the scraping tool of FIG. 1.

A typical embodiment of the scraping tool comprising the present invention is shown in FIGS. 1 and 2. The tool is preferably formed of sheet metal which is of the desired stiffness to dislodge rigid paint from a paint can rim and lid. The invention includes a can rim scraping blade 20 and a lid scraping blade 30 at opposite ends of a handle 10. Handle 10 includes a rectangular planar segment 12 long enough and of sufficient width to accommodate a human hand. Continuing from both ends of planar segment 12 is an upward bend 14, causing a planar slant 16, of the same width as planar segment 12, to incline roughly thirty degrees in respect to planar segment 12. Slant 16 adds to the rigidness of the tool as well as forming a thumb rest when in use. Slant 16 terminates at a downward bend 18. At the fore end of the tool is can rim scraping blade 20, which extends downward from bend 18 at roughly seventy-five degrees, in respect to slant 16. Beginning at bend 18, the width of blade 20 is reduced in syncline angle to a junction 21.

Figure 3:
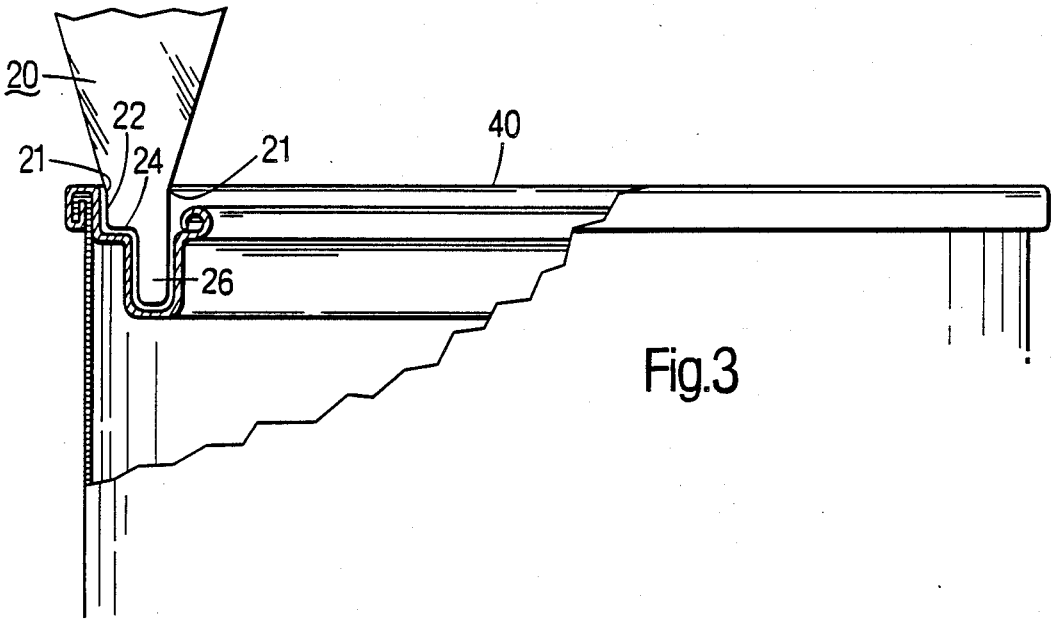
FIG. 3 is a front elevational view of the rim blade of the scraping tool of FIG. 1, in use, during scraping of the rim component of a paint can friction seal, the seal component being shown in transverse section.

FIG. 3 shows an elevational view of rim blade 20 and the rim area of a typical paint can having a friction seal top 40. The tool is positioned by scraping the rim component of the friction seal. The seal component shown, is the usual cross sectional configuration. In concentric orientation, progressing towards the center of the can, the configuration includes a circumferential juncture, a recessed shoulder, a relatively deep recess and a rolled inner lip. Rim blade 20 is substantially flat and rigid while displaying a generally corresponding contour edge to the recessed form of the seal component. This contour includes a vertical edge 22 continuing from junction 21 to a horizontal edge 24 which joins a tongue 26 which may or may not be slightly tapered. Tongue 26 extends to the end of blade 20 from edge 24 and junction 21. The corners of blade 20 are typically rounded to avoid scoring of the seal surface. The respective matching parts of the seal configuration and blade 20 are conformed to each other but do not need precise congruency. The overall dimensions of the blade shape are slightly less than those of the seal cavity. This allows the tool to be used on cans with slightly different cross sectional seal dimensions. It is desirable that the tool move without encumbrance within the seal cavity, so pressure may be directed to surfaces that need more cleaning.

Figure 4:
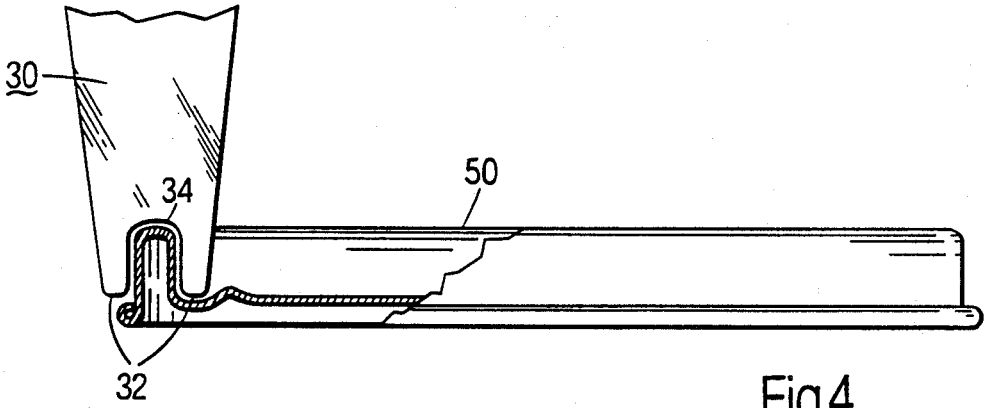
FIG. 4 is a front elevational view of the lid blade of the scraping tool of FIG. 1, in use, during scraping of the lid component of a paint can friction seal, the seal component being shown in transverse section.

Best shown in FIGS. 1 and 2 is lid scraping blade 30, as it originates from the aft end of the tool at bend 18. The downward projection of lid blade 30 is roughly seventy-five degrees in respect to slant 16. This angle is identical to that of rim blade 20 at the fore end of the tool. At bend 18, the width of blade 30 is reduced in syncline angle to the rounded points of a taper terminus 32. Referring to FIG. 4 there is shown, in elevational view, lid blade 30 and the lid of a typical paint can having a friction seal top 50. The tool is positioned for scraping the lid component of the friction seal. The seal component follows a commonly standard cross sectional configuration. In concentric orientation, progressing towards the center of the lid, the configuration includes a circumferential rolled edge, a relatively large vertical rib and an ogee curve. The ogee curve, which is adjacent the large rib, is an S-curve which may be seen in FIG. 4 as comprising a concave curve followed by an inner, convex curve in the cross-section of the lid of the paint can. Lid blade 30 is substantially flat and rigid while displaying a generally corresponding contour edge to the salient form of the seal component. This contour includes a rounded notch 34 centered in the end of blade 30. The rounded points of taper terminus 32 on both sides of notch 34 are shaped to scrape, or clean, the form around the base of the rib. The respective matching parts of the seal configuration and blade 30 are conformed to each other but do not need precise congruency. The overall dimensions of the blade shape are slightly larger than those of the seal form. This allows the tool to be used on lids with slightly different cross sectional seal dimensions. It is desirable that the tool move without encumbrance over the seal form, so pressure may be directed to surfaces that need more cleaning.

OPERATION

The appropriate surfaces of a paint can friction seal are efficiently cleaned using the scraping tool. As shown in FIGS. 1 and 2, the invention is comprised of two scraping blades at either end of the tool. The tool is held so as to direct the scraping action either to the rim or lid component of the seal.

To clean the can rim component of the seal, one holds the tool in hand with rim scraping blade 20 forward of the thumb. While holding the can securely on a level surface, blade 20 is inserted into the seal cavity, comprising a deep recess and an outer, recessed shoulder, as shown in FIG. 3. The cleaning of the seal surface is accomplished by exerting slight downward pressure, while propelling blade 20 in short strokes, circumvolving the can. Pressure is easily adjusted to direct the scraping action to surfaces of the seal that need more cleaning. Canting the tool about a horizontal or vertical axis may enhance contact of blade 20 and the seal configuration.

Conversely, to clean the lid component of the seal, one holds the tool with lid scraping blade 30 forward of the thumb. While holding the lid securely on a level surface, blade 30 is placed over the seal form, as shown in FIG. 4. The cleaning of the seal surface is accomplished by exerting slight downward pressure, while propelling blade 30 in short strokes, circumvolving the lid. Pressure is easily adjusted to direct the scraping action to surfaces of the seal that need more cleaning. Canting the tool about a horizontal or vertical axis may enhance contact of blade 30 and the seal configuration.

CONCLUSION, RAMIFICATIONS AND SCOPE

Accordingly, the reader will see that the scraping tool of the invention can be used to easily remove paint residue from the friction seal of a paint can. The seal is cleaned completely, as both the rim and lid components of the seal are addressed by the tool. The scraping tool helps maintain the integrity of the friction seal to provide for an airtight and leak proof container. Thus, helping to eliminate the loss of paint due to evaporation. In addition, the elimination of accumulated paint residue helps to prevent the fusion of the lid to the can while in storage. The scraping blades of the tool are shaped to correspond specifically to the surfaces of the friction seal, allowing the tool to be used on assorted sizes of cans. The shape also permits the tool to be used on cans of various manufacture, which may have slightly different friction seal dimensions.

While my above description contains many specificities, these should not be construed as limitations on the scope of the invention, but rather as an exemplification of one preferred embodiment thereof. Many other variations are possible. For example, the shape of the scraping blades may be slightly altered to more precisely approximate the friction seal configuration of a particular manufacture of can. In addition, the degree of angle of both the upward and downward bends of the tool can be increased or decreased. The flat planes of the handle and blades may be arched. The tool can also be made of other materials such as plastic, graphite, etc. Furthermore, the shape of the blades can be altered to permit the tool to be used on other types of containers.

Accordingly, the scope of the invention should be determined not by the embodiments illustrated, but by the appended claims and their legal equivalents.

I claim:

1. An integrated, hand-held tool for scraping the surfaces of a paint can friction seal between the can rim and the lid of the can, comprising:

(a) friction seal scraping means for cleaning selected surfaces of said can rim and friction seal scraping means for cleaning selected surfaces of said lid, (b) a handle comprised of a rectangular, planar segment (c) an upwardly inclined planar segment disposed at each end of said handle, each said inclined segment adapted to receive the thumb of the hand, (d) a downwardly inclined planar segment continuing from each said upwardly inclined planar segment, and (e) said friction seal scraping means for said can rim being disposed at the end of one of said downwardly inclined planar segments and said friction seal scraping means for said lid being disposed at the end of the other of said downwardly inclined planar segments.

2. The combination recited in claim 1, wherein said friction seal scraping means for said can rim and for said lid, each extend downwardly from said downwardly inclined planar segments, wherein said downward pressure on the handle and downward and forward pressure on the inclined segments for receiving the thumb are directly transmitted to said scraping means.

3. The combination recited in claim 2 for cleaning the friction sealing means of a paint can rim which comprises a deep recess and an outer, recessed shoulder, said friction seal scraping means for said can rim, said scraping means consisting of a horizontal edge disposed between a vertical edge, extending upwardly from said horizontal edge and a vertical tongue extending downwardly from said horizontal edge, said vertical edge and said horizontal edge disposed to clean said recessed shoulder and said vertical tongue disposed to clean said recess in said paint can rim.

4. The combination recited in claim 3 for cleaning a recess formed in part by the inner rim in said paint can, wherein said friction seal scraping means for said can rim extends clear of said inner rim.

5. The combination recited in claim 2 for cleaning the friction sealing means of a paint can lid, said sealing means comprising in cross-section, when said lid is turned over from its customary position on a paint can, a concentric vertical rib and an inner, concentric, ogee surface formed by a first surface which is concave and a second surface which is convex, said friction seal scraping means for said lid comprising a blade having a notch therein adapted to receive said vertical rib, said blade adapted to scrape said surface which is concave near the base of said vertical rib and said blade being disposed to extend clear of said curve which is convex.

* * * * *